US006263515B1

(12) United States Patent
Turner et al.

(10) Patent No.: US 6,263,515 B1
(45) Date of Patent: Jul. 24, 2001

(54) PROTECTIVE HEADWEAR FOR A CHILD

(76) Inventors: Arnold R. Turner; Donna G. Turner, both of 7801 Ebb Tide Dr., New Orleans, LA (US) 70126

( * ) Notice: Subject to any disclaimer, the term of this patent is extended or adjusted under 35 U.S.C. 154(b) by 0 days.

(21) Appl. No.: 09/552,788

(22) Filed: Apr. 20, 2000

(51) Int. Cl.[7] ..... A42B 3/00
(52) U.S. Cl. ..... 2/410; 2/414
(58) Field of Search ..... 2/410, 411, 412, 2/414, 415, 417, 418, 421, 422, 425

(56) References Cited

U.S. PATENT DOCUMENTS

| | | | | |
|---|---|---|---|---|
| 532,567 | * | 1/1895 | Larwood, Jr. | 2/421 |
| 2,706,294 | * | 4/1955 | Sprinkle | 2/414 |
| 2,717,384 | * | 9/1955 | Frothingham | 2/414 |
| 2,969,547 | * | 1/1961 | Dye | 2/411 |
| 3,555,561 | * | 1/1971 | Neis | 2/411 |
| 3,609,763 | * | 10/1971 | Raney | 2/415 |
| 4,001,894 | * | 1/1977 | Roques-Rogery | 2/415 |
| 4,062,067 | * | 12/1977 | Franzen | 2/410 |
| 5,075,903 | * | 12/1991 | Richoux | 2/411 |
| 5,337,420 | * | 8/1994 | Haysom et al. | 2/410 |
| 5,437,064 | * | 8/1995 | Hamaguchi | 2/414 |
| 5,481,759 | * | 1/1996 | Rinaldi | 2/195.1 |
| 5,745,923 | * | 5/1998 | Katz | 2/411 |
| 5,768,715 | * | 6/1998 | Gregg, III et al. | 2/411 |
| 5,790,988 | * | 8/1998 | Guadagnino, Jr. et al. | 2/411 |

* cited by examiner

*Primary Examiner*—Michael A. Neas

(57) ABSTRACT

A protective headwear for a child for preventing head injuries to babies and toddlers. The protective headwear for a child includes a frame including an adjustable and padded band, a visor extending from a front of the band, and four arcuate cover support members each having a pair of ends which are detachably attachable to the band intermediate portion of each of the arcuate cover support members are coupled together; and also includes a cover having a tail-like portion extending downwardly from a back thereof and being padded to protect the back of a child's neck and being securely fitted over and about the frame; and further includes a plurality of hook and loop fasteners being securely attached to the ends of the arcuate cover support members and to the band. As an option, a chin strap having ends with hook and loop fasteners securely attached thereof is detachably attached to the band.

9 Claims, 2 Drawing Sheets

PROTECTIVE HEADWEAR FOR A CHILD

BACKGROUND OF THE INVENTION

1. Field of the Invention

The present invention relates to a child play safe hat and more particularly pertains to a new protective headwear for a child for preventing head injuries to babies and toddlers.

2. Description of the Prior Art

The use of a child play safe hat is known in the prior art. More specifically, a child play safe hat heretofore devised and utilized are known to consist basically of familiar, expected and obvious structural configurations, notwithstanding the myriad of designs encompassed by the crowded prior art which have been developed for the fulfillment of countless objectives and requirements.

Known prior are includes U.S. Pat. Nos. 4,581,773; 5,657,492; 3,696,441; 5,081,717; 3,366,971; and U.S. Pat. No. Des. 369,014.

While these devices fulfill their respective, particular objectives and requirements, the aforementioned patents do not disclose a new protective headwear for a child. The inventive device includes a frame including an adjustable and padded band, a visor extending from a front of the band, and four arcuate cover support members each having a pair of ends which are detachably attachable to the band intermediate portions of each of the arcuate cover support members are coupled together; and also includes a cover having a tail-like portion extending downwardly from a back thereof and being padded to protect the back of a child's neck and being securely fitted over and about the frame; and further includes a plurality of hook and loop fasteners being securely attached to the ends of the arcuate cover support members and to the band. As an option, a chin strap having ends with hook and loop fasteners securely attached thereof is detachably attached to the band.

In these respects, the protective headwear for a child according to the present invention substantially departs from the conventional concepts and designs of the prior art, and in so doing provides an apparatus primarily developed for the purpose of preventing head injuries to babies and toddlers.

SUMMARY OF THE INVENTION

In view of the foregoing disadvantages inherent in the known types of child play safe hat now present in the prior art, the present invention provides a new protective headwear for a child construction wherein the same can be utilized for preventing head injuries to babies and toddlers.

The general purpose of the present invention, which will be described subsequently in greater detail, is to provide a new protective headwear for a child which has many of the advantages of the child play safe hat mentioned heretofore and many novel features that result in a new protective headwear for a child which is not anticipated, rendered obvious, suggested, or even implied by any of the prior art child play safe hat, either alone or in any combination thereof.

To attain this, the present invention generally comprises a frame including an adjustable and padded band, a visor extending from a front of the band, and four arcuate cover support members each having a pair of ends which are detachably attachable to the band intermediate portions of each of the arcuate cover support members are coupled together; and also includes a cover having a tail-like portion extending downwardly from a back thereof and being padded to protect the back of a child's neck and being securely fitted over and about the frame; and further includes a plurality of hook and loop fasteners being securely attached to the ends of the arcuate cover support members and to the band. As an option, a chin strap having ends with hook and loop fasteners securely attached thereof is detachably attached to the band.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective headwear for a child which has many of the advantages of the child play safe hat mentioned heretofore and many novel features that result in a new protective headwear for a child which is not anticipated, rendered obvious, suggested, or even implied by any of the prior art child play safe hat, either alone or in any combination thereof.

It is another object of the present invention to provide a new protective headwear for a child which may be easily and efficiently manufactured and marketed.

It is a further object of the present invention to provide a new protective headwear for a child which is of a durable and reliable construction.

An even further object of the present invention is to provide a new protective headwear for a child which is susceptible of a low cost of manufacture with regard to both materials and labor, and which accordingly is then susceptible of low prices of sale to the consuming public, thereby making such protective headwear for a child economically available to the buying public.

Still yet another object of the present invention is to provide a new protective headwear for a child which provides in the apparatuses and methods of the prior art some of the advantages thereof, while simultaneously overcoming some of the disadvantages normally associated therewith.

Still another object of the present invention is to provide a new protective headwear for a child for preventing head injuries to babies and toddlers.

Yet another object of the present invention is to provide a new protective headwear for a child which includes a frame including an adjustable and padded band, a visor extending from a front of the band, and four arcuate cover support members each having a pair of ends which are detachably attachable to the band intermediate portions of each of the arcuate cover support members are coupled together; and also includes a cover having a tail-like portion extending downwardly from a back thereof and being padded to protect the back of a child's neck and being securely fitted over and about the frame; and further includes a plurality of hook and loop fasteners being securely attached to the ends of the arcuate cover support members and to the band. As an option, a chin strap having ends with hook and loop fasteners securely attached thereof is detachably attached to the band.

Still yet another object of the present invention is to provide a new protective headwear for a child that can be easily and conveniently adjusted to fit all sizes.

Even still another object of the present invention is to provide a new protective headwear for a child that is extremely lightweight and protects regions of the child's head and neck never protected before.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
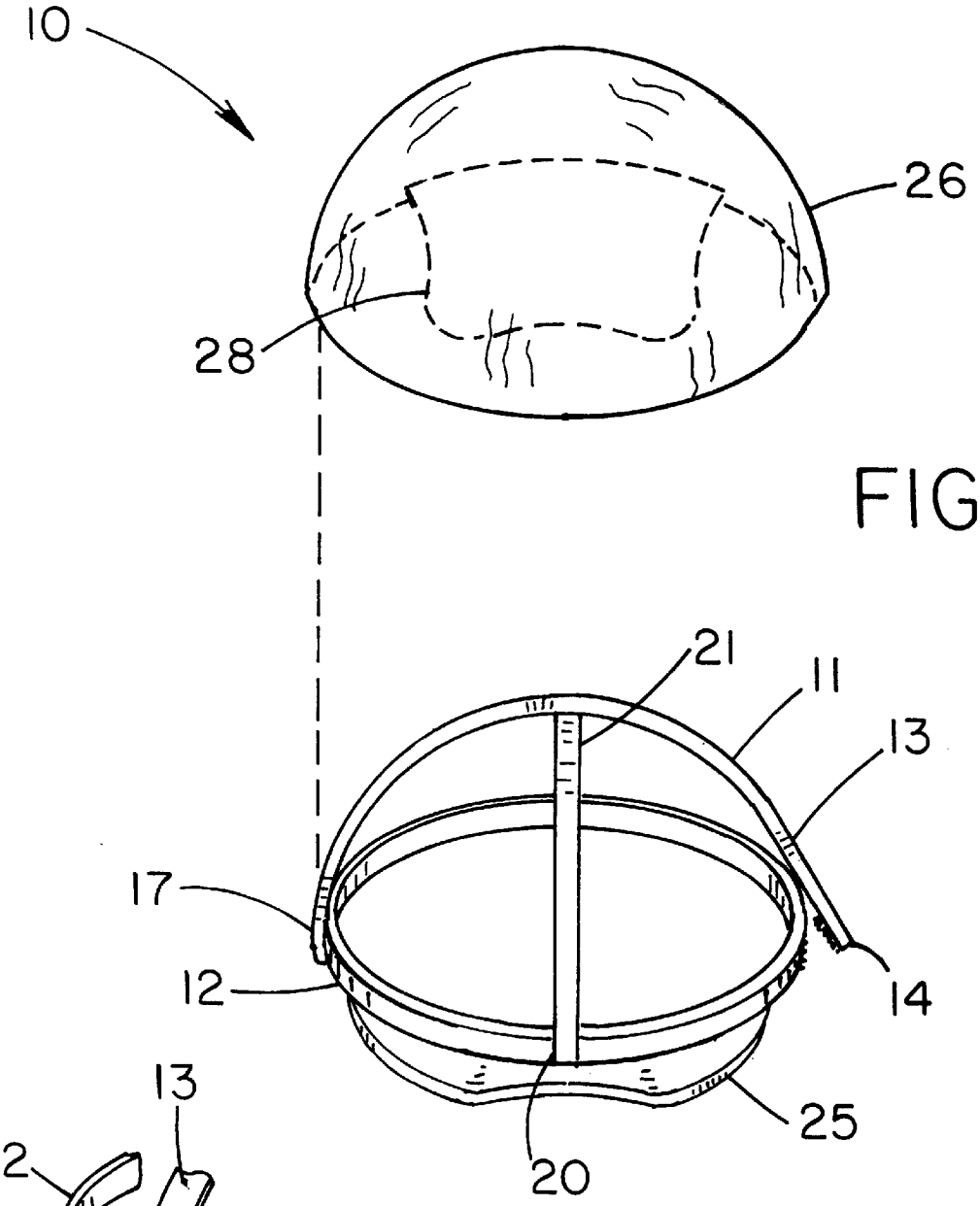
FIG. 1 is an exploded perspective view of a new protective headwear for a child according to the present invention.
Figure 2:
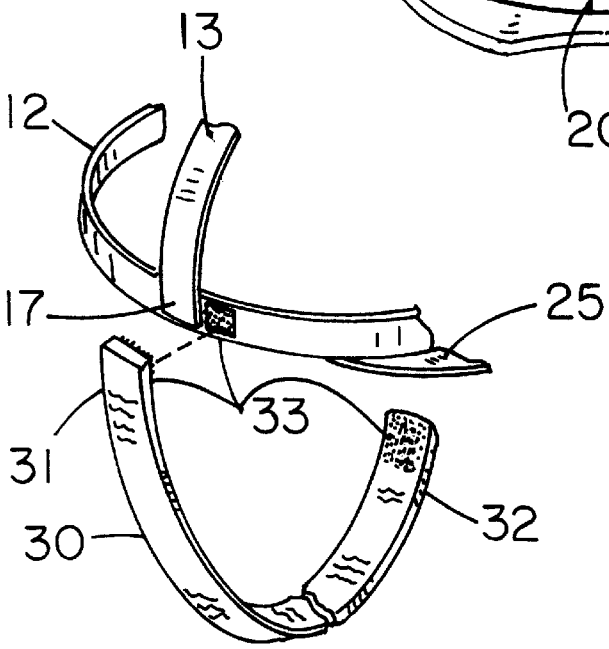
FIG. 2 is an exploded perspective view of the chin strap and a portion of the frame of the present invention.
Figure 3:
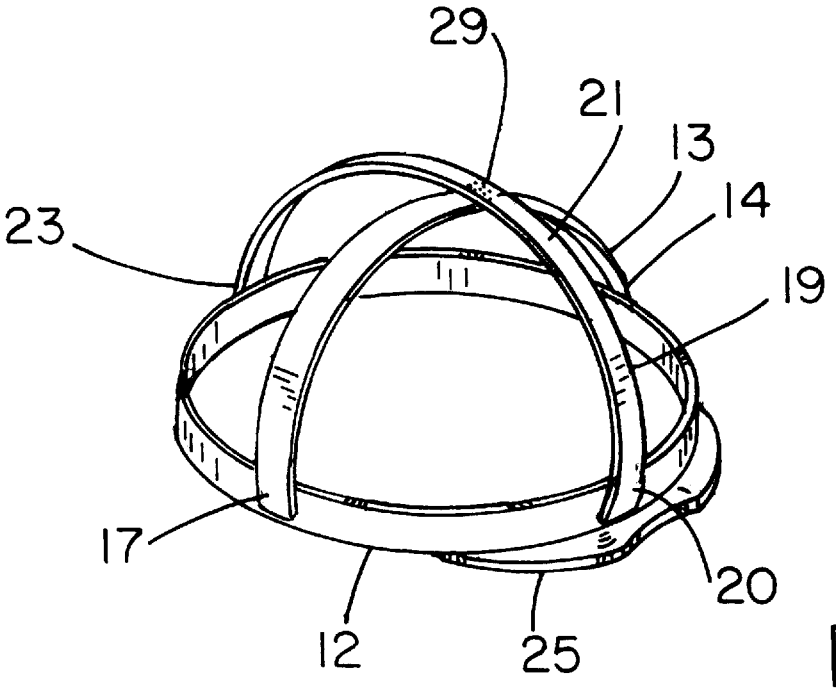
FIG. 3 is a perspective view of the frame of the present invention.
Figure 4:
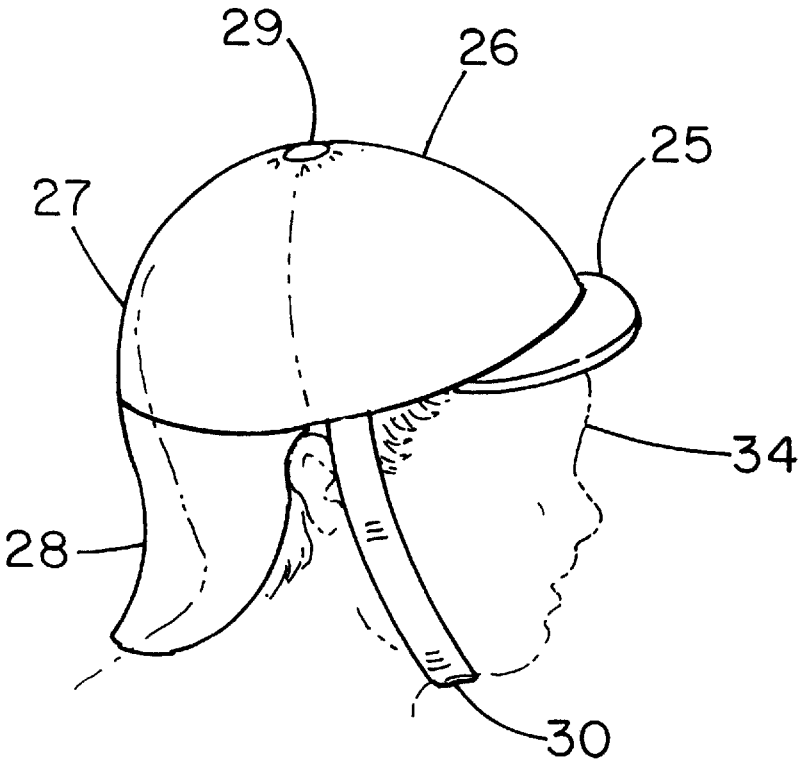
FIG. 4 is a perspective view of the present invention being worn by a child.

With reference now to the drawings, and in particular to FIGS. 1 through 4 thereof, a new protective headwear for a child embodying the principles and concepts of the present invention and generally designated by the reference numeral 10 will be described.

As best illustrated in FIGS. 1 through 4, the protective headwear for a child 10 generally comprises a semi-rigid frame 11 including a padded band 12 having ends detachably attachable to one another for adjusting a circumference of the band 12 and having a front. A visor 25 is integrally connected to the front of the band 12 and extending forwardly thereof. The semi-rigid frame 11 also includes a cover support coupling region 29, and a plurality of adjustable arcuate cover support members 13, 19 each of which includes a first end 14, 26 being detachably attached to the band 12 and a second end 17, 23 being securely and detachably attached to the cover support coupling region 29. The arcuate cover members 13, 19 are adapted to archingly extend over the band 12 which is made of plastic. The band 12 is adapted to adjust to fit all sizes of heads 34 of children with the band 12 being adapted to fit about a child's head 34. The protective headwear for a child 10 also includes a cover 26 having a back 27 and a tail-like portion 28 integrally extending downwardly from the back 27 of the cover 26 to essentially protect and cushion a back of a child's neck. The cover 26 has an underside and is securely fitted over a top of the arcuate cover support members 13, 19 and the cover support coupling region 29 and the band 12. The tail-like portion 28 of the cover 26 includes a padded member adapted to protect a back of a child's neck. The cover support coupling region 29 is adapted to be centrally disposed above the band 12 and to support the underside of a crown of the cover 26. A plurality of fastening members 33 are securely attached and sewn to the band 12 and to the arcuate cover support members 13, 19 and to the cover support coupling region 29. The fastening members 33 are securely attached to the first 14, 20 and second 17,23 ends of the arcuate cover support members 13,19 and to a back, sides and to the front of an exterior of the band 12 with the fastening members 33 being essentially hook and loop fasteners.

As an option, the protective headwear for a child 10 includes a chin strap 30 having ends 31, 32 with the hook and loop fasteners securely attached and sewn thereto for detachably attaching to the band 12.

In use, the arcuate cover support members 13, 19 are detachably attached at their first ends 14, 20 about the back, sides and front of the band 12 and are detachably attached at their second ends 17, 23 to the cover support coupling region 29 with the band 12 being adjusted to fit the head 34 of the child who is going to wear it. The cover 26 is securely fitted over the frame 11 with the protective headwear 10 now being ready for the child to wear. If desirable, the chin strap 30 can be easily and conveniently attached at its ends 31, 32 to the band 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A protective headwear for a child comprising:

a semi-rigid frame including a padded band having a front, a visor integrally connected to said front of said band and extending forwardly thereof, and a plurality of adjustable arcuate cover support members each of which includes a pair of ends being detachably attached to said band, intermediate portions of each of said arcuate cover support members being coupled together, said arcuate cover support members being adapted to archingly extend over said band;

a cover having a back and tail-like portion integrally extending downwardly from said back of said cover to essentially protect and cushion a back of a child's neck, said cover having an underside and being securely fitted over a top of said arcuate cover support members and said band; and a plurality of fastening members securely attached to said band and to said arcuate cover support members.

2. A protective headwear for a child as described in claim 1, wherein said band and said arcuate cover support members are made of plastic.

3. A protective headwear for a child as described in claim 2, wherein said band is adapted to adjust to fit all sizes of heads of children, said band being adapted to fit about a child's head.

4. A protective headwear for a child as described in claim 1, wherein said fastening members are securely attached to said first and second ends of said arcuate cover support members and to a back, sides and said front of an exterior of said band.

5. A protective headwear for a child as described in claim 1, wherein said fastening members are essentially hook and loop fasteners.

6. A protective headwear for a child as described in claim 1, wherein said tail-like portion of said cover includes a padded member adapted to protect a back of a child's neck.

7. A protective headwear for a child as described in claim 1, further including a chin strap having ends with said hook and loop fasteners securely attached thereto for detachably attaching to said band.

8. A protective headwear for a child comprising:

a semi-rigid frame including a padded band having a front, a visor integrally connected to said front of said band and extending forwardly thereof, and a plurality of adjustable arcuate cover support members each of which includes a pair of ends being detachably attached to said band, intermediate portions of each of said arcuate cover support members being coupled together, said arcuate cover support members being adapted to archingly extend over said band which made of plastic, said band being adapted to adjust to fit all sizes of heads of children, said band being adapted to fit about a child's head;

a cover having a back and a tail-like portion integrally extending downwardly from said back of said cover to essentially protect and cushion a back of a child's neck, said cover having an underside and being securely fitted over a top of said arcuate cover support members and said band, said tail-like portion of said cover including a padded member adapted to protect a back of a child's neck; and a plurality of fastening members securely attached to said band and to said arcuate cover support members said fastening members being securely attached to said first and second ends of said arcuate cover support members and to a back, sides and said front of an exterior of said band, said fastening members being essentially hook and loop fasteners.

9. A protective headwear for a child as described in claim 8, further including a chin strap having ends with said hook and loop fasteners securely attached thereto for detachably attaching to said band.

* * * * *